US007677955B2

(12) United States Patent
Kajiyama et al.

(10) Patent No.: US 7,677,955 B2
(45) Date of Patent: Mar. 16, 2010

(54) GRINDING METHOD FOR WAFER

(75) Inventors: Keiichi Kajiyama, Ota-Ku (JP); Takatoshi Masuda, Ota-ku (JP); Shinya Watanabe, Ota-ku (JP); Shigehiko Aoki, Ota-Ku (JP); Hirotoshi Hoshikawa, Ota-Ku (JP); Yoshikazu Kobayashi, Ota-ku (JP); Seiji Harada, Ota-ku (JP); Setsuo Yamamoto, Ota-ku (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 12/243,483

(22) Filed: Oct. 1, 2008

(65) Prior Publication Data

US 2009/0098808 A1 Apr. 16, 2009

(30) Foreign Application Priority Data

Oct. 10, 2007 (JP) ..... 2007-264172

(51) Int. Cl.
*B24B 49/00* (2006.01)

(52) U.S. Cl. ..... 451/11; 451/41; 451/53; 451/287; 451/449

(58) Field of Classification Search ..... 451/10, 451/11, 41, 53, 285, 287, 288, 449, 550
See application file for complete search history.

(56) References Cited

U.S. PATENT DOCUMENTS 6,966,826 B2 * 11/2005 Suzuki et al. ..... 451/450
2003/0032382 A1 * 2/2003 Suzuki et al. ..... 451/450
2006/0079155 A1 * 4/2006 Nakamura et al. ..... 451/41
2007/0004180 A1 * 1/2007 Abe ..... 438/460
2008/0003929 A1 * 1/2008 Degen ..... 451/359
2008/0039000 A1 * 2/2008 Bennett et al. ..... 451/363
2008/0076329 A1 * 3/2008 Sekiya et al. ..... 451/41
2008/0076334 A1 * 3/2008 Yoshida et al. ..... 451/177
2008/0090505 A1 * 4/2008 Yoshida et al. ..... 451/413
2008/0318497 A1 * 12/2008 Kimura et al. ..... 451/54
2009/0068936 A1 * 3/2009 Kuhnle et al. ..... 451/344

FOREIGN PATENT DOCUMENTS

JP A 2006-41258 2/2006

* cited by examiner

*Primary Examiner*—Eileen P. Morgan
(74) *Attorney, Agent, or Firm*—Greer, Burns & Crain, Ltd.

(57) ABSTRACT

A grinding method for a wafer having a plurality of devices on the front side, wherein the back side of the wafer is ground by a grinding wheel to suppress the motion of heavy metal in the wafer by a gettering effect and also to maintain the die strength of each device at about 1,000 MPa or more. The grinding wheel is composed of a frame and an abrasive member fixed to the free end of the frame. The abrasive member is produced by fixing diamond abrasive grains having a grain size of less than or equal to 1 μm with a vitrified bond. A protective member is attached to the front side of the wafer and the wafer is held on a chuck table in the condition where the protective member is in contact with the chuck table. The grinding wheel is rotated as rotating the chuck table to thereby grind the back side of the wafer by means of the abrasive member so that the average surface roughness of the back side of the wafer becomes less than or equal to 0.003 μm and the thickness of a strain layer remaining on the back side of the wafer becomes 0.05 μm.

5 Claims, 7 Drawing Sheets

GRINDING METHOD FOR WAFER

BACKGROUND OF THE INVENTION

1. Field of the Invention

The present invention relates to a method of grinding the back side of a wafer to improve the die strength of the wafer.

2. Description of the Related Art

The back side of a wafer having a plurality of devices such as ICs and LSIs on the front side is ground to reduce the thickness of the wafer to a predetermined value. Thereafter, the wafer is separated into the individual devices, which are in turn used in various kinds of electronic equipment. In recent years, the thickness of the wafer in the condition prior to separation into the individual devices has been further reduced to meet the requirement of further reduction in size and weight of electronic equipment. In the case that the back side of a wafer is polished to reduce the thickness of the wafer to 100 μm or less, for example, there arises a problem such that a gettering effect of suppressing the motion of heavy metal such as copper contained in the wafer may be reduced to cause a reduction in quality of each device separated from the wafer.

To cope with this problem, there has been proposed a technique such that the back side of a wafer is ground to form a strain layer, thereby producing a gettering effect and accordingly suppressing the motion of heavy metal in the wafer (see Japanese Patent Laid-open No. 2006-41258, for example). However, in the case that the strain layer is formed on the back side of the wafer, the die strength or strength against fracture of each device separated from the wafer may be reduced to cause a reduction in quality and life.

SUMMARY OF THE INVENTION

It is therefore an object of the present invention to provide a grinding method for a wafer which can produce a gettering effect without reducing the die strength of a wafer and each device.

In accordance with an aspect of the present invention, there is provided a grinding method for a wafer by using a grinding apparatus including a chuck table for holding the wafer and grinding means having a rotatable grinding wheel for grinding the wafer held on the chuck table, wherein the back side of the wafer having a plurality of devices on the front side is ground by the grinding wheel to suppress the motion of heavy metal in the wafer by a gettering effect and also to maintain the die strength of each device at substantially 1,000 MPa or more, wherein the grinding wheel is composed of a frame and an abrasive member fixed to the free end of the frame, the abrasive member being produced by fixing diamond abrasive grains having a grain size of less than or equal to 1 μm with a vitrified bond; a protective member is attached to the front side of the wafer, and the wafer is held on the chuck table in the condition where the protective member is in contact with the chuck table; and the grinding wheel is rotated as rotating the chuck table to thereby grind the back side of the wafer by means of the abrasive member so that the average surface roughness of the back side of the wafer becomes less than or equal to 0.003 μm and the thickness of a strain layer remaining on the back side of the wafer becomes 0.05 μm.

Preferably, the rotational speed of the chuck table is 100 to 400 rpm, the rotational speed of the grinding wheel is 1,000 to 6,000 rpm, the feed speed of the grinding means is 0.05 to 0.5 μm/sec and the grinding water usage is 2 to 10 liters/min.

According to the present invention, the back side of the wafer is ground by using the abrasive member produced by fixing diamond abrasive grains having a grain size of less than or equal to 1 μm with a vitrified bond so that the average surface roughness of the back side of the wafer becomes 0.003 μm or less and the thickness of the strain layer remaining on the back side of the wafer becomes 0.05 μm. Accordingly, a gettering effect can be produced with the die strength of each device maintained at substantially 1,000 MPa or more.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
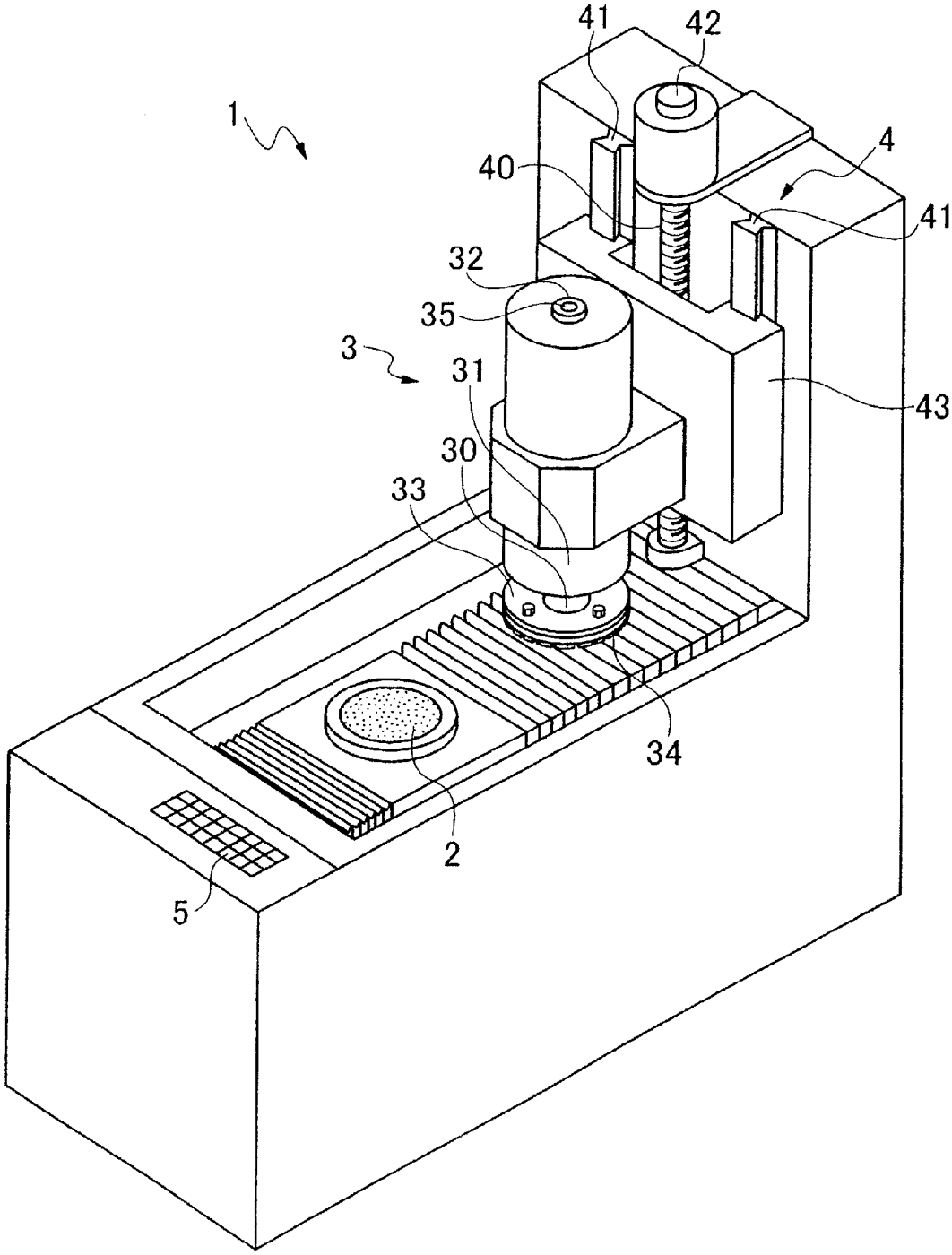
FIG. 1 is a perspective view of a grinding apparatus usable in performing the method according to the present invention.

Referring to FIG. 1, there is shown a grinding apparatus 1 capable of grinding a wafer to obtain a desired final thickness. The grinding apparatus 1 includes a chuck table 2 for holding the wafer and grinding means 3 for grinding the wafer held on the chuck table 2. The chuck table 2 is movable in a horizontal direction and rotatable about a vertical axis. The chuck table 2 can be rotationally driven at a predetermined rotational speed by a motor (not shown).

The grinding means 3 includes a spindle 30 having a vertical axis, a housing 31 for rotatably supporting the spindle 30, a motor 32 connected to the spindle 30 for rotationally driving the spindle 30, a wheel mount 33 formed at the lower end of the spindle 30, a grinding wheel 34 fixed to the wheel mount 33, and a water inlet 35 for a grinding water. The grinding wheel 34 can be rotationally driven at a predetermined rotational speed by the motor 32.

The grinding means 3 is vertically fed by feeding means 4. The feeding means 4 includes a vertically extending ball screw 40, a pair of guide rails 41 extending parallel to the ball screw 40, a pulse motor 42 for rotating the ball screw 40, and a slider 43 having a nut (not shown) threadedly engaged with the ball screw 40 and a pair of side portions slidably engaged with the pair of guide rails 41, thus vertically movably supporting the grinding means 3. Accordingly, when the ball screw 40 is rotated by the pulse motor 42, the slider 43 is vertically moved as being guided by the guide rails 41, so that the grinding means 3 is vertically moved at a predetermined feed speed.

Figure 2:
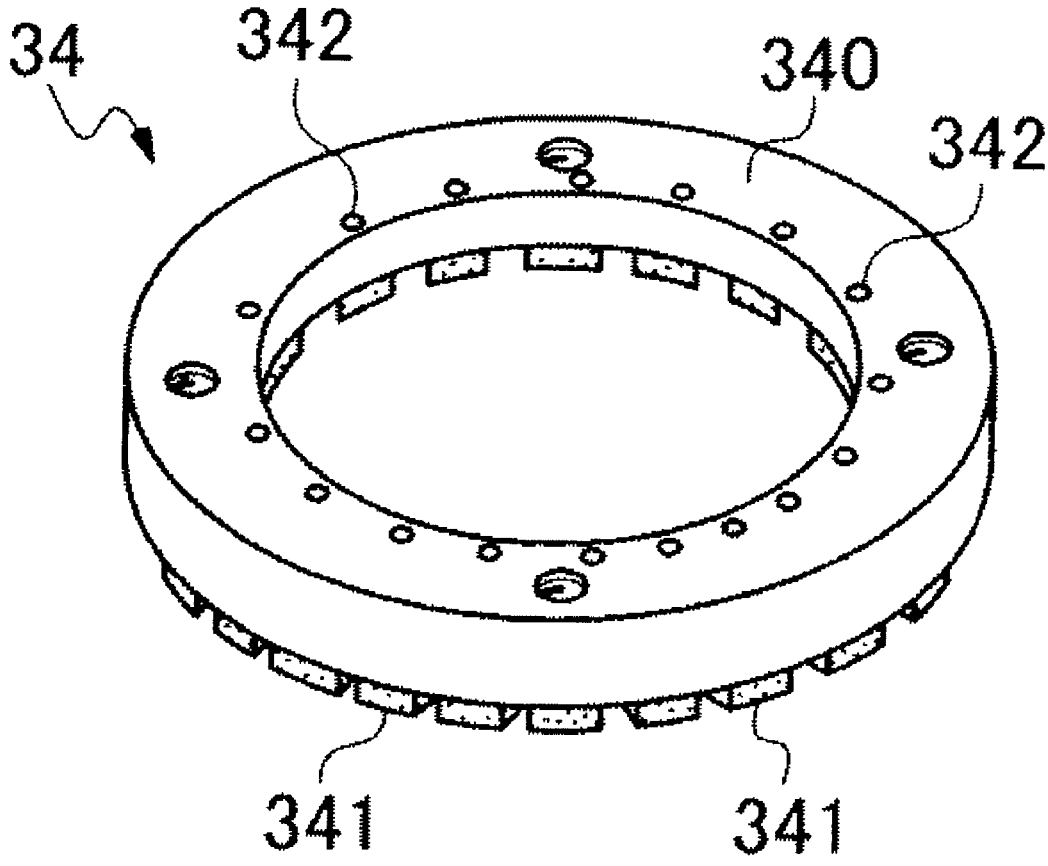
FIG. 2 is a perspective view of a grinding wheel included in the grinding device shown in FIG. 1.
Figure 3:
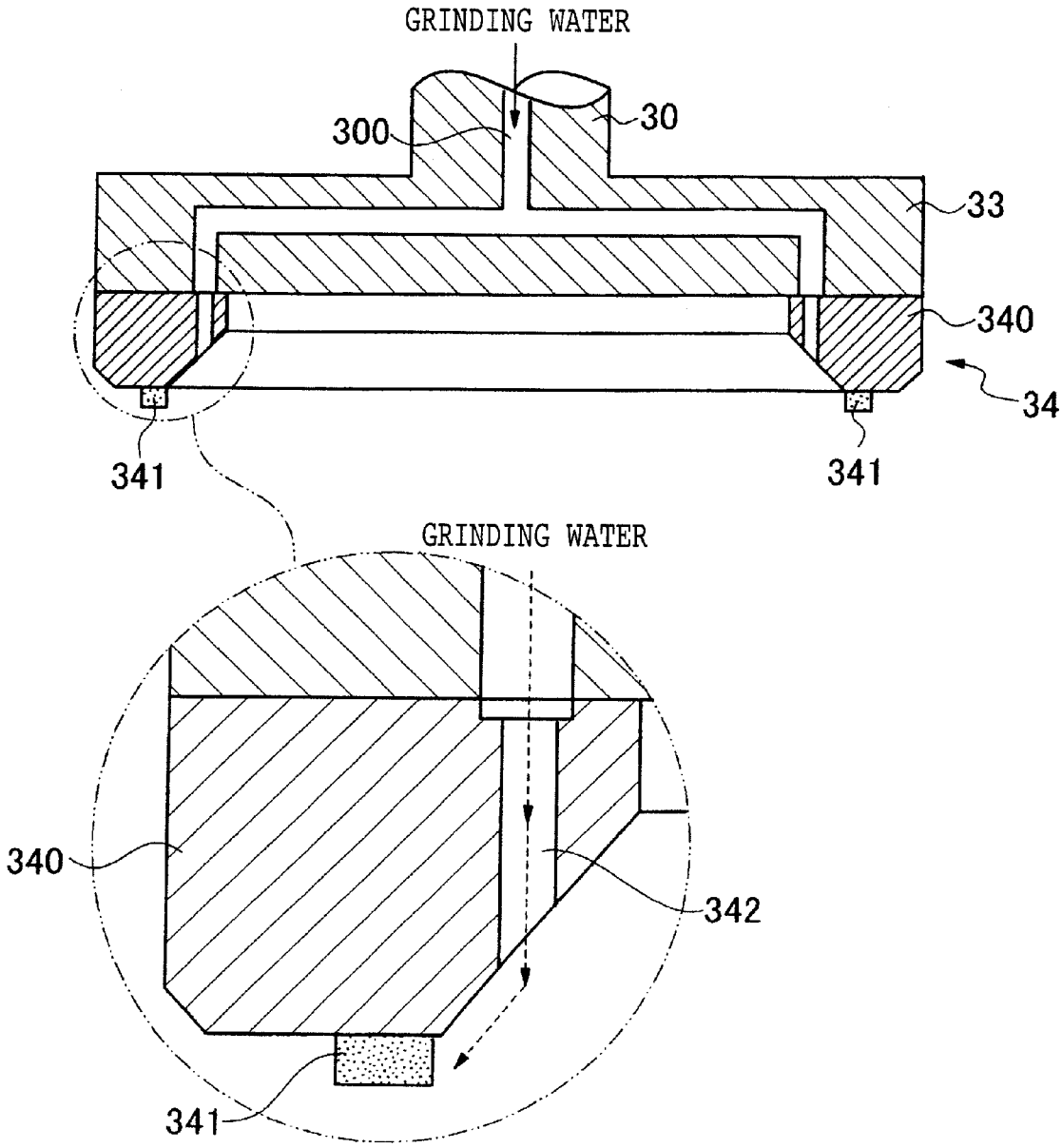
FIG. 3 is a sectional view of the grinding wheel and a part of a spindle included in the grinding apparatus shown in FIG. 1.

As shown in FIG. 2, the grinding wheel 34 is composed of an annular frame 340 and a plurality of abrasive members 341 fixed to the free end (lower surface) of the annular frame 340 so as to be spaced in the circumferential direction of the annular frame 340. Each abrasive member 341 is produced by fixing diamond abrasive grains with a vitrified bond. As shown in FIG. 3, the spindle 30 having the wheel mount 33 is formed with a water passage 300 for supplying the grinding water, and the frame 340 of the grinding wheel 34 is also formed with a water passage 342 communicating with the water passage 300 for vertically supplying the grinding water toward each abrasive member 341. Accordingly, in grinding the wafer by using the grinding means 3, the grinding water is supplied from the water inlet 35 through the water passages 300 and 342 to the position where each abrasive member 341 comes into contact with the wafer. Various operational conditions in grinding the wafer can be input from an operation panel 5 shown in FIG. 1.

Figure 4:
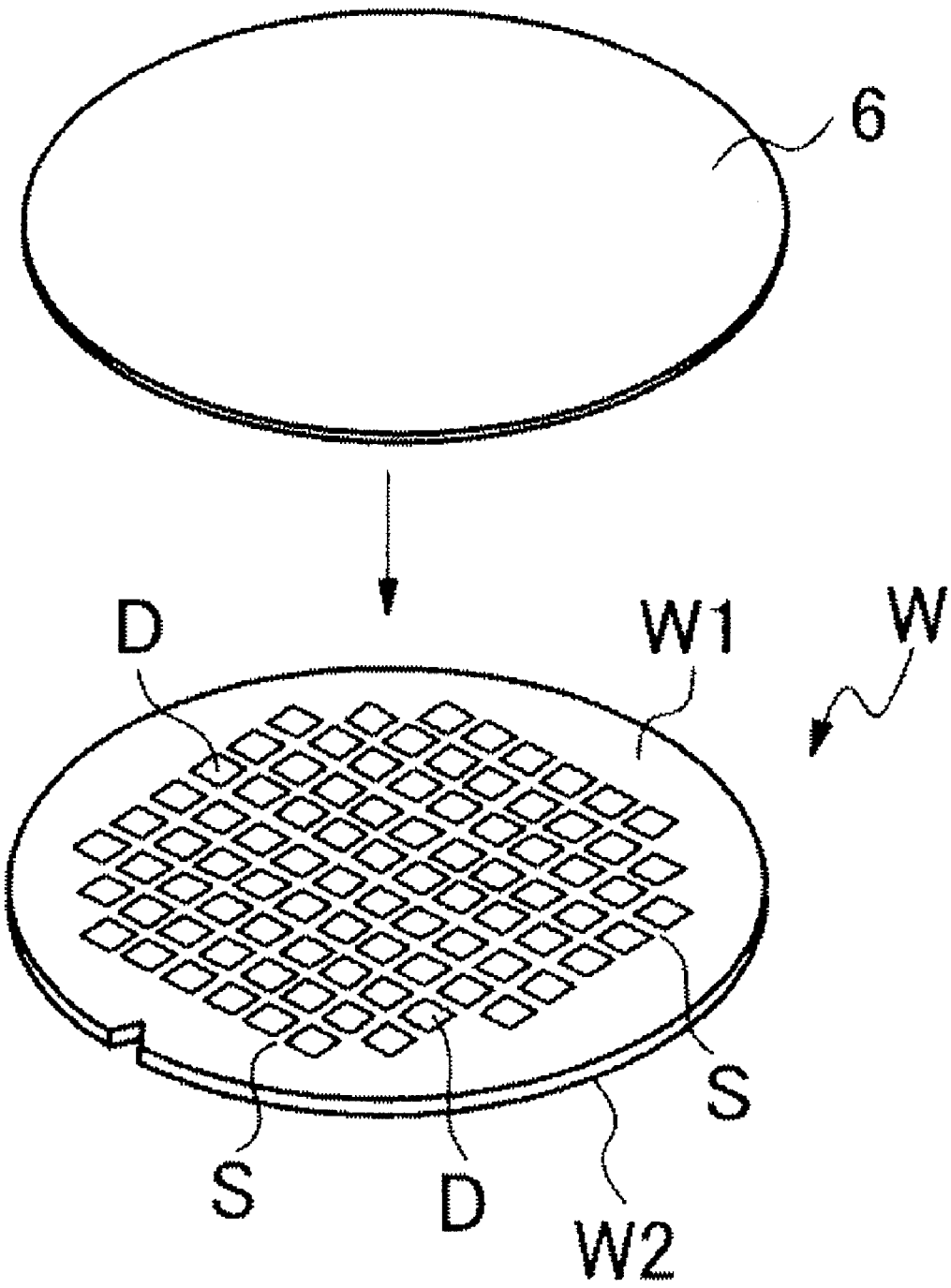
FIG. 4 is a perspective view of a wafer and a protective member in the condition prior to attaching the protective member to the wafer.
Figure 5:
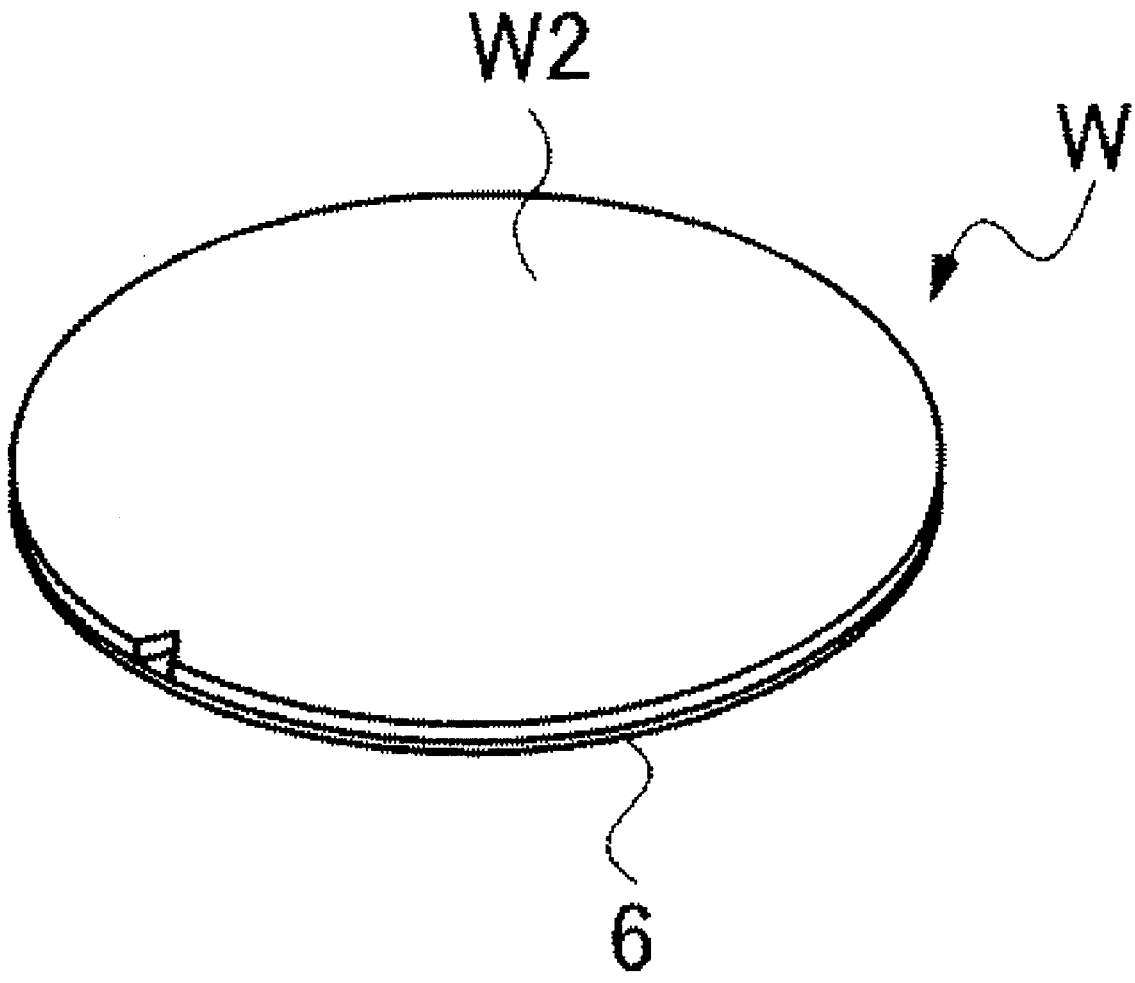
FIG. 5 is a perspective view of the wafer in the condition where the protective member is attached to the front side of the wafer.
Figure 6:
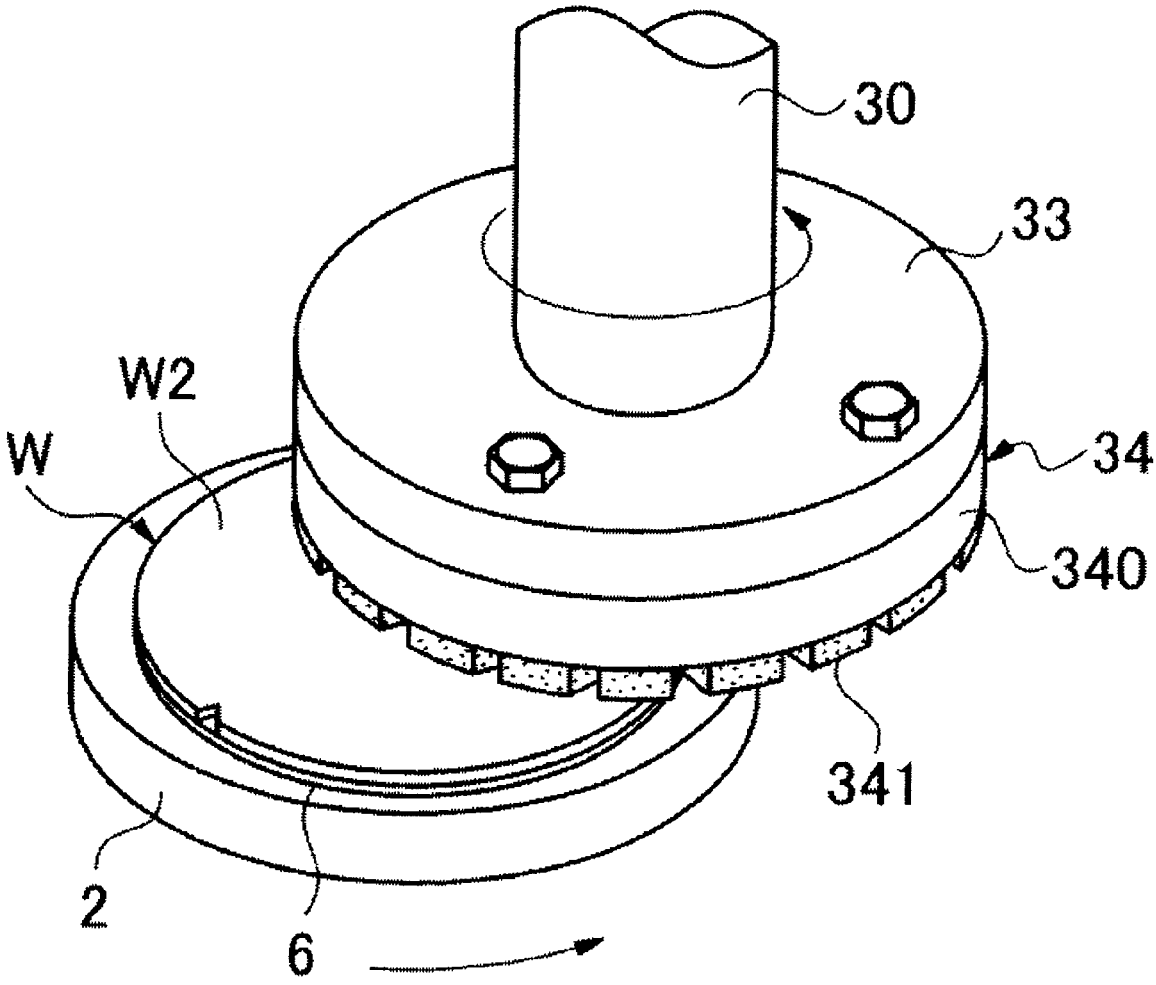
FIG. 6 is a perspective view showing the condition where the back side of the wafer is ground by the grinding wheel.
Figure 7:
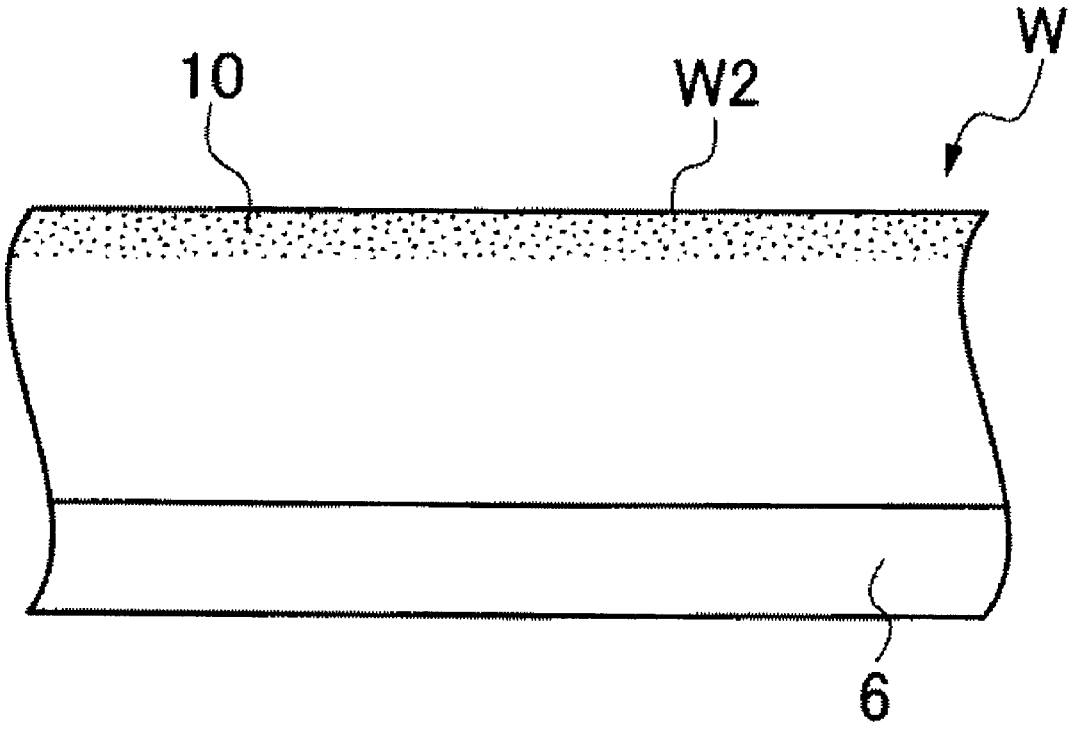
FIG. 7 is a sectional view for illustrating a strain layer present on the back side of the wafer.

As shown in FIG. 4, a plurality of crossing streets S are formed on the front side W1 of a wafer W to thereby partition a plurality of devices D. Prior to grinding the back side W2 of the wafer W, a protective member 6 for protecting the devices D is attached to the front side W1 of the wafer W, and as shown in FIG. 5 the back side W2 of the wafer W is oriented upward. As shown in FIG. 6, the wafer W is held on the chuck table 2 in the condition where the protective member 6 on the front side W1 of the wafer W is in contact with the chuck table 2 and the back side W2 of the wafer W is exposed. The chuck table 2 thus holding the wafer W is moved to the position directly below the grinding means 3. At this position, the grinding wheel 34 is rotated by the motor 32 and the grinding means 3 is simultaneously lowered by the feeding means 4 to bring the abrasive members 341 into contact with the back side W2 of the wafer W which is being rotated, thus grinding the back side W2 of the wafer W until a predetermined thickness of the wafer W is reached. As a result, a strain layer 10 is formed on the back side W2 of the wafer W as shown in FIG. 7.

Example 1

As the abrasive members 341 shown in FIGS. 2, 3, and 6, abrasive members produced by fixing diamond abrasive grains having a grain size of less than or equal to 1 μm with a vitrified bond (which abrasive members will be hereinafter referred to as "abrasive members A") were prepared. As a comparison, abrasive members produced by fixing diamond abrasive grains having an average grain size of 2 μm with a vitrified bond (which abrasive members will be hereinafter referred to as "abrasive members B") were also prepared. By using the abrasive members A, the back sides of a plurality of silicon wafers were ground. Similarly, by using the abrasive members B, the back sides of a plurality of silicon wafers were ground. The operational conditions in grinding the wafers by using the abrasive members A were similar to those in grinding the wafers by using the abrasive members B except the difference in grain size. The operational conditions were changed in the following ranges.

Rotational speed of the chuck table 2: 100 to 400 rpm

Rotational speed of the grinding wheel 34: 1,000 to 6,000 rpm

Feed speed of the grinding means 3: 0.05 to 0.5 μm/sec

Grinding water usage in the grinding means 3: 2 to 10 liters/min

After grinding all of the wafers, the surface roughness of the back side (ground surface) of each wafer was measured. As the surface roughness, an arithmetic mean roughness (Ra) and a maximum height (Ry) defined by JISB0601 (ISO4287) were used. In the case of grinding by the abrasive members A, the maximum value of the arithmetic mean roughnesses (Ra) of the back sides of all the wafers ground was 0.003 μm, and the maximum value of the maximum heights (Ry) of the back sides of all the wafers ground was 0.012 μm. Further, the average value of the thicknesses of the strain layers remaining on the back sides of all the wafers ground was 0.05 μm. On the other hand, in the case of grinding by the abrasive members B, the maximum value of the arithmetic mean roughnesses (Ra) of the back sides of all the wafers ground was 0.006 μm and the maximum value of the maximum heights (Ry) of the back sides of all the wafers ground was 0.044 μm. Further, the average value of the thicknesses of the strain layers remaining on the back sides of all the wafers ground was 0.08 μm.

Each wafer ground by the abrasive members A was separated into individual devices by using a dicing device and some of the individual devices were randomly sampled to be subjected to the measurement of a die strength. Similarly, each wafer ground by the abrasive members B was separated into individual devices by using the same dicing device, and some of the individual devices were randomly sampled to be subjected to the measurement of a die strength. The die strength was measured by using a ball rupturing test. As the result of this measurement, the maximum value and minimum value of the die strengths of the sampled devices separated from each wafer ground by the abrasive members A were 2,364 MPa and 998 MPa, respectively, and the average value was 1,638 MPa. On the other hand, the maximum value and minimum value of the die strengths of the sampled devices separated from each wafer ground by the abrasive members B were 953 MPa and 476 MPa, respectively, and the average value was 650 MPa.

The above-mentioned results show that the surface roughness and die strength are improved in the case of using the abrasive members A as compared with the case of using the abrasive members B. Further, in the case of using the abrasive members A, the average value of the thicknesses of the strain layers is 0.05 μm as mentioned above, so that the motion of heavy metal in each wafer can be suppressed by a gettering effect. Further, in the case of using the abrasive members A, the die strength of each device can be maintained at about 1,000 MPa or more in the condition where the strain layer having an average thickness of 0.05 μm is formed. Thusly, by maintaining the die strength of each device at about 1,000 MPa or more, the stability of the quality of electronic equipment using the device according to the present invention can be maintained.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A grinding method for a wafer by using a grinding apparatus including a chuck table for holding said wafer and grinding means having a rotatable grinding wheel for grinding said wafer held on said chuck table, wherein the back side of said wafer having a plurality of devices on the front side is ground by said grinding wheel to suppress the motion of heavy metal in said wafer by a gettering effect, said grinding wheel including a frame and an abrasive member fixed to the free end of said frame, said abrasive member being produced by fixing diamond abrasive grains having a grain size of less than or equal to 1 μm with a vitrified bond, said grinding method comprising the steps of:

attaching a protective member to the front side of said wafer;

holding said wafer on said chuck table in the condition where said protective member is in contact with said chuck table; and rotating said grinding wheel and said chuck table to thereby grind the back side of said wafer by means of said abrasive member so that the average surface roughness of the back side of said wafer becomes less than or equal to 0.003 μm and the thickness of a strain layer remaining on the back side of said wafer becomes 0.05 μm;

wherein each device produced by dividing said wafer has a die strength of substantially 1,000 MPa or more; and wherein the rotational speed of said chuck table is 100 to 400 rpm, the rotational speed of said grinding wheel is 1,000 to 6,000 rpm, the feed speed of said grinding means is 0.05 to 0.5 μm/sec and the grinding water usage is 2 to 10 liters/min.

2. The grinding method for a wafer according to claim 1, wherein the rotational speed of said chuck table is 300 to 400 rpm, the rotational speed of said grinding wheel is 1,000 to 6,000 rpm, the feed speed of said grinding means is 0.05 to 0.5 μm/sec and the grinding water usage is 2 to 10 liters/min.

3. The grinding method for a wafer according to claim 1, wherein the rotational speed of said chuck table is 100 to 400 rpm, the rotational speed of said grinding wheel is 1,000 to 4,000 rpm, the feed speed of said grinding means is 0.05 to 0.5 μm/sec and the grinding water usage is 2 to 10 liters/min.

4. The grinding method for a wafer according to claim 1, wherein the rotational speed of said chuck table is 100 to 400 rpm, the rotational speed of said grinding wheel is 5,500 to 6,000 rpm, the feed speed of said grinding means is 0.05 to 0.5 μm/sec and the grinding water usage is 2 to 10 liters/min.

5. The grinding method for a wafer according to claim 1, wherein the rotational speed of said chuck table is 100 to 400 rpm, the rotational speed of said grinding wheel is 1,000 to 6,000 rpm, the feed speed of said grinding means is 0.05 to 0.5 μm/sec and the grinding water usage is 5 to 10 liters/min.

* * * * *